United States Patent [19]

White, Jr.

[11] Patent Number: 4,779,586

[45] Date of Patent: Oct. 25, 1988

[54] INTERNAL COMBUSTION ENGINE AIR CLEANER INLET DIFFUSER

[75] Inventor: John A. White, Jr., Grand Blanc, Mich.

[73] Assignee: General Motors Corporation, Detroit, Mich.

[21] Appl. No.: 144,331

[22] Filed: Jan. 15, 1988

[51] Int. Cl.[4] ..... F22B 5/02

[52] U.S. Cl. ..... 123/198 E; 239/589; 239/DIG. 7; 55/190; 55/462

[58] Field of Search ..... 55/190, 194, 434, 462, 55/463, 491, 521; 123/198 E; 239/589, 595, DIG. 7

[56] References Cited

U.S. PATENT DOCUMENTS

| | | | |
|---|---|---|---|
| 668,484 | 2/1901 | Bok | 239/589 X |
| 2,297,239 | 9/1942 | Neugebauer et al. | 239/589 X |

*Primary Examiner*—Charles Hart

*Attorney, Agent, or Firm*—R. L. Phillips

[57] ABSTRACT

An internal combustion engine air cleaner has a bent inlet diffuser of certain geometry that allows it to be significantly shorter than but at least as effective as a straight inlet diffuser.

3 Claims, 4 Drawing Sheets

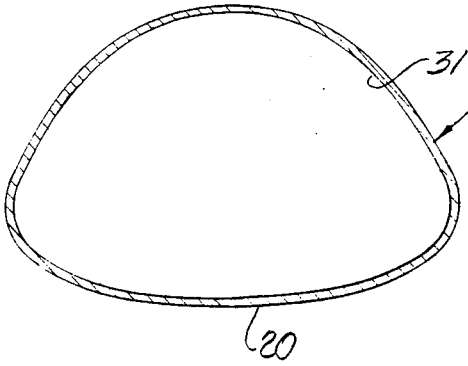
Fig. 5A
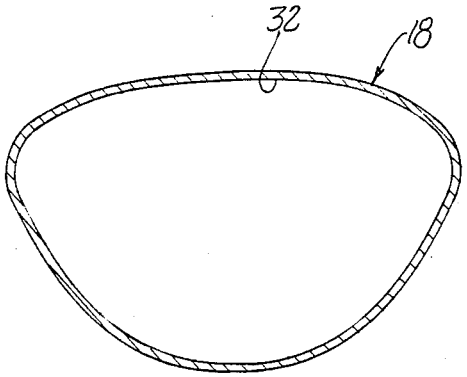
Fig. 5B
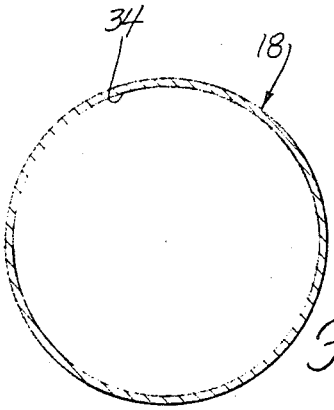
Fig. 5C
Fig. 6A
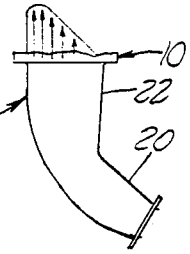
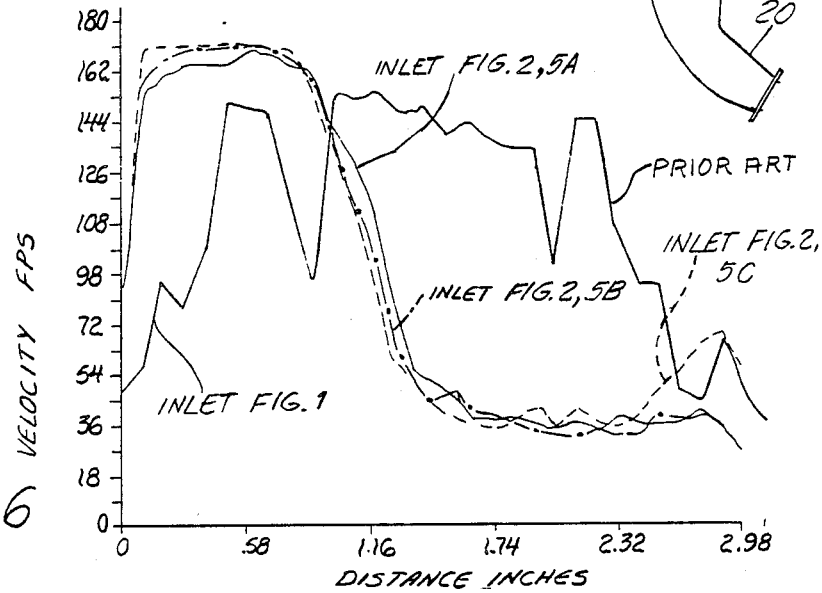
Fig. 6

INTERNAL COMBUSTION ENGINE AIR CLEANER INLET DIFFUSER

TECHNICAL FIELD

This invention relates to internal combustion engine air cleaner inlet diffusers and more particularly to the configuration thereof.

BACKGROUND OF THE INVENTION

In an internal combustion engine powered vehicle, the primary function of the inlet diffuser (also called a snorkel) on the engine's air cleaner is to supply air to the air cleaner with low airflow restriction and low induction noise. The inlet of the diffuser is typically small to reduce radiated induction noise and the outlet area is large to minimize air cleaner flow restriction.

Heretofore, air cleaner snorkels have been shaped like conventional straight symmetrical diffusers so as to operate to expand the high speed incoming air to the snorkel to a low exiting speed as low speed air entering the air cleaner has less restriction than high speed air. While the straight symmetrical diffuser has been found to be the most efficient shape for an air cleaner inlet, they tend to be very difficult to package in modern aerodynamic cars which because of fuel economy reasons have been downsized and streamlined resulting in a substantial reduction in the size of the engine compartment and in particular the space for the air cleaner with its snorkel. For example, it is often required that the air cleaner inlet be short and wind through a crowded engine compartment. However, for a straight diffuser to perform well it must normally exceed ten inches in straight length which is a requirement that conflicts with available modern underhood space.

SUMMARY OF THE INVENTION

The present invention offers a significantly shorter length inlet diffuser with the same optimum exit area/inlet area ratio as a conventional diffuser by forming the diffuser with a prescribed bend and certain other prescribed diffuser geometry. For example and comparison, a conventional straight diffuser found to be highly efficient has an 8° included angle but is difficult to package in a modern small car. If the inlet thereof is maintained at 1.5" diameter for silencing effectiveness, the diffuser must then be 11" long to expand the flow to a 3" diameter duct or air cleaner inlet to reduce the inlet air flow to the cleaner to the desired low speed. The bent or angulated inlet diffuser of the present invention with the same exit area/inlet area ratio as the straight diffuser above can maintain the same level of performance within a length of 7" which is a reduction in length of about 35% with favorable exit conditions. And the shorter length of the angulated inlet diffuser coupled with the bend results in a snorkel of excellent performance in a very packageable configuration.

The improved performance provided by the angulated or bent diffuser is attributed to flow separation control. Straight conventional diffusers that have the same inlet area, outlet area and length as the bent diffusers have complete circumferential flow separation on the diffuser walls. This separation produces noise and turbulence which in turn causes flow restriction. In contrast, flow separation in the bent diffuser of the present invention is confined to the inside of the bend and as a result, the flow remains attached on about 75% of the diffuser wall resulting in less turbulence and flow restriction. This is brought about by the discovery of a certain combination of critical factors determining the diffuser geometry that allow the maintenance of performance level with significantly foreshortened length. First of all, it was discovered that the inlet area controls the noise radiation and that it should be less than about 2.5" diameter for most engine induction systems but not less than 1.0" diameter or flow restriction will be exclusive. The diffusion angle on the other hand should not exceed 20° otherwise it was found that there will be adverse flow separation. And if the diffusion angle is less than 10°, the diffuser length will then become excessive. In addition, the included angle of the bend should be at least 120° to ensure adequate secondary flow strength to maintain flow attachment. But the bend should not exceed 155° included angle or else the flow restriction was then found to become excessive. In addition, the bend should be at least 1.5 times the effective inlet diameter away from the inlet as a shorter distance was found to result in high speed flow at the bend that increases flow restriction. And lastly, the outlet should be at least 2.5" diameter to minimize air cleaner restrictions bearing in mind that the outlet area should be as large as possible while holding all the other above constraints.

An object of the present invention is to provide a new and improved internal combustion air cleaner inlet diffuser.

Another object is to provide an internal combustion engine air cleaner having an angulated inlet diffuser of minimum length.

Another object is to provide an internal combustion engine air cleaner having a bent inlet diffuser of significantly shorter length but substantially the equivalent performance of a straight inlet diffuser.

DESCRIPTION OF THE PREFERRED EMBODIMENT

These and other objects, advantages and features of the present invention will become more apparent from the following description and drawing in which:

FIGS. 5A, 5B and 5C are cross-sectional views taken along the line 5—5 in FIG. 2 of various embodiments of the bent inlet diffuser.

FIGS. 6–9 are graphs comparing the operating characteristics of the bent inet diffusers in FIGS. 1–5 with the straight prior art inlet diffuser in FIG. 1.

FIGS. 6A, 7A, 8A and 9A show the orientation of the bent defuser velocity measurements in FIGS. 6, 7, 8 and 9 respectively.

Figure 1:
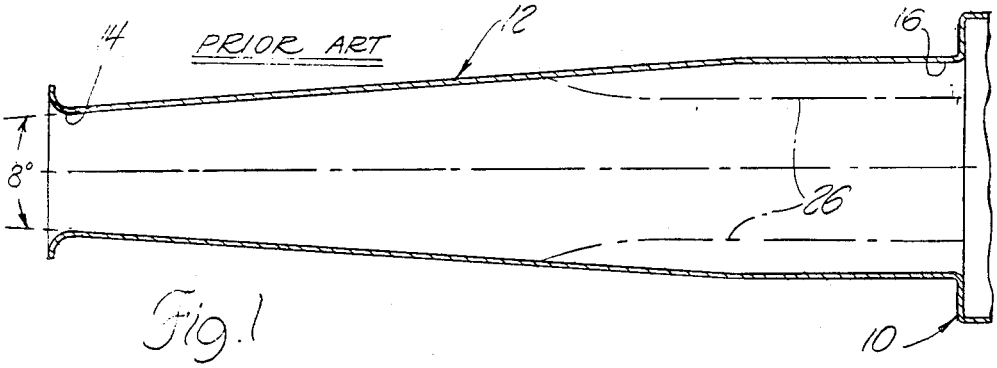
FIG. 1 is a longitudinal sectional view of a conventional internal combustion engine air cleaner inlet diffuser.
Figure 2:
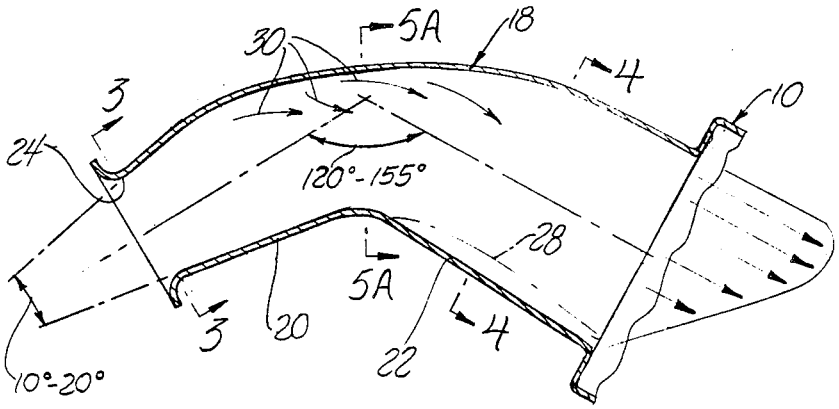
FIG. 2 is a longitudinal sectional view of an angulated internal combustion engine air cleaner inlet diffuser according to the present invention.
Figure 3:
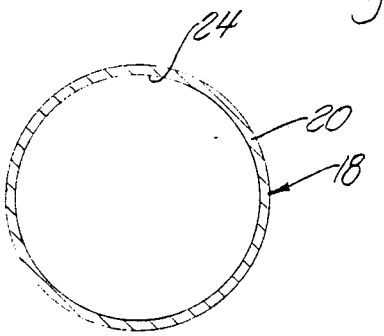
FIG. 3 is a cross-sectional view taken along the line 3—3 in FIG. 2.

Referring to FIG. 1, the conventional internal combustion engine air cleaner 10 (only the inlet portion thereof being shown) has an efficient straight inlet diffuser or snorkel 12 with an 8° included angle of diffusion, a circular inlet 14 of 1.5" diameter, and a length of 11" to expand the flow to a circular outlet 16 of 3.0" diameter. Under favorable exit conditions, the inlet diffuser 18 according to the present invention and shown in FIGS. 2 and 5 offers iimilar performance to that shown in FIG. 1 with a substantially shorter length. The bent or angulated inlet diffuser 18 comprises interconnected entry and exit stages 20 and 22 having centerlines that intersect at an included angle of about 120° to 155° and flow areas that diverge along their respective centerline. The entry stage 20 has a circular inlet 24 as shown in FIG. 3 of 1.0 to 2.5" diameter and increases in flow area substantially uniformly along its centerline at a larger than conventional diffusion angle of about 10° to 20°. It was found that the bend angle should be at least 120° to assure adequate secondary flow strength to maintain flow attachment but should not exceed 155° so that the flow restriction does not become excessive. On the other hand, it was found that the length of the entry stage 20 should be at least 1.5 times the equivalent inlet diameter as a shorter distance was found to result in high speed flow at the bend that significantly increases the flow restriction. The exit stage 22 also diverges but its taper or diffusion angle is determined on the basis that its diameter should be at least 2.5" diameter to minimize restriction and be as large as possible while holding the other above constraints.

Figure 4:
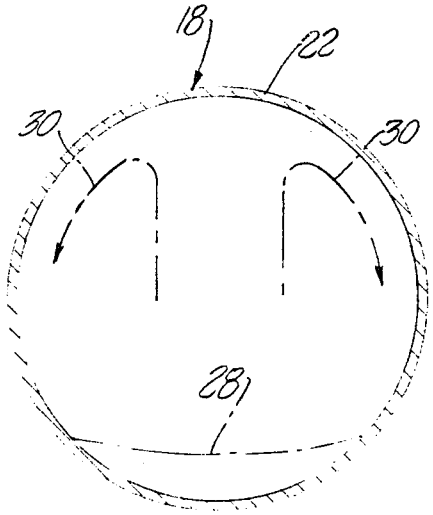
FIG. 4 is a cross-sectional view taken along the line 4—4 in FIG. 2.
Figure 7:
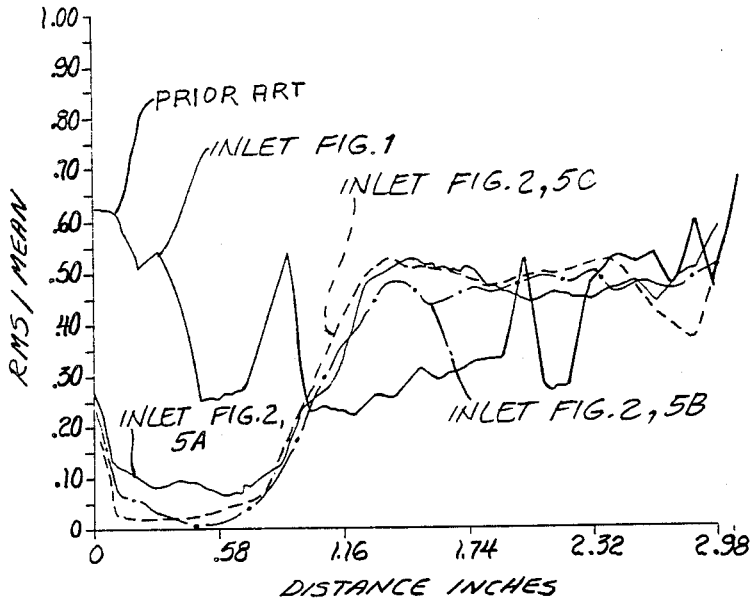
Figure 7A:
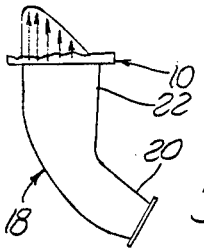
Figure 8A:
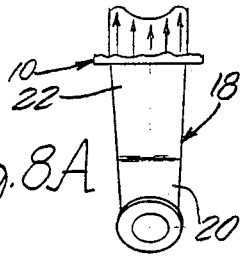
Figure 8:
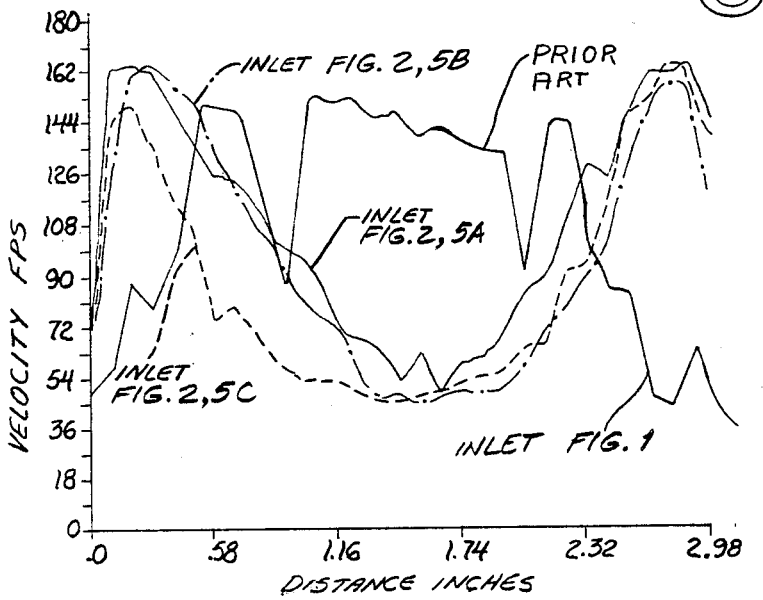
Figure 9:
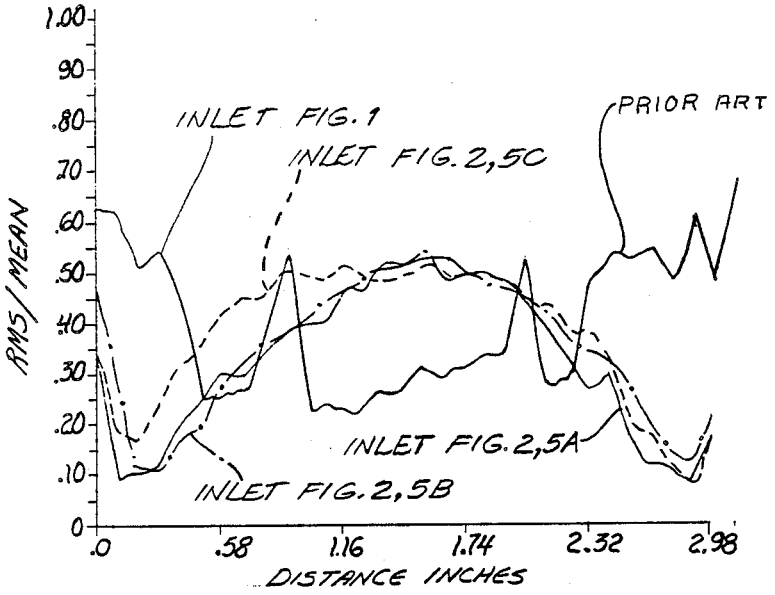
Figure 9A:
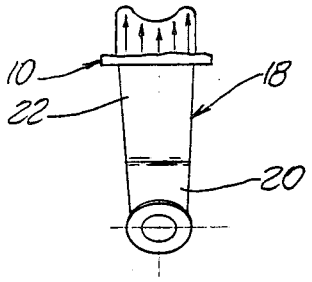

As mentioned earlier, the straight conventional diffusers typically has complete circumferential flow separation and this is shown at 26 in FIG. 1. This separation produces noise and turbulence which in turn causes flow restriction. Flow separation in the present invention however is confined by the bent diffuser to the inside of the bend as shown at 28 in FIGS. 2 and 4 so that the flow remains attached to about 75% of the diffuser wall resulting in less turbulence and flow restriction.

The shape of the flow area at the junction of the two stages can take various forms. For example, this interstage area may as shown in FIG. 5A have a high aspect ratio profile 31 (larger width than height) and be relatively flat-sided at the inner radius of the bend. Or it may have a cross-sectional area 32 as shown in FIG. 5B which is the inverse of that in FIG. 5A with the flatter side at the outer radius of the bend. Or, the interstage may simply be of circular shape as indicated at 34 in FIG. 5C.

Examples of the bent diffusers shown in FIGS. 2–5 were compared with the conventional diffuser in FIG. 1 on a 1000 CFM flow stand by making direct pressure and velocity measurements. For such comparison, all four diffusers were formed with an inlet/outlet area ratio of 40, inlet diameter of 1.5", length of 7" and diffusion angle of 15°. The bent diffusers differed from the conventional inlet diffuser by all having a bend with an included angle of 135° and with the two non-circular interstage cross-sections 31 and 32 having a 1.7 aspect ratio.

Each inlet diffuser was examined on the flow stand with static pressure being measured with a water manometer located 4" downstream of the diffuser exit. manometer locate The restriction data collected and reproduced in Table 1 below revealed that the bent diffuser with the interstage section of FIG. 5A performed slightly better than those of FIGS. 5B and 5C. However, all bent inlets performed significantly better than the conventional straight diffuser in FIG. 1.

TABLE 1

| RESTRICTION WITHOUT AIR CLEANER ASSEMBLY (INCHES OF WATER) | | |
|---|---|---|
| | FLOW RATE (GRAMS/SEC.) | |
| INLET DIFFUSER | 82.5 gm/sec | 137.5 gm/sec |
| FIG. 2-5A | 2.1" | 6.0" |
| FIG. 2-5B | 2.3" | 6.6" |
| FIG. 2-5C | 2.3" | 6.1" |
| FIG. 1 | 2.7" | 7.3" |

| RESTRICTION WITH CONVENTIONAL AIR CLEANER ASSEMBLY AT 137.5 GRAMS/SEC. FLOW RATE | |
|---|---|
| INLET DIFFUSER | INCHES OF WATER |
| FIG. 2-5A | 9.0" |
| FIG. 2-5B #2 | 9.7" |
| FIG. 2-5C #3 | 9.5" |
| FIG. 2-5D #4 | 11.0" |

In addition, velocity measurements were made with hot wire anemometry equipment using three hot wire traces at 45° adjacent angles across the inlet's exit. The results of these tests are reproduced in FIGS. 6–9 and it will be seen that all the bent diffuser embodiments have similar velocity profiles that are significantly different from the conventional diffuser.

The velocity profiles were examined using three velocity profile correction terms defined as follows:

$$\text{Momentum Correction Factor } B = \frac{u^2 dA}{V^2 A}$$

$$\text{Kinetic Energy Correction Factor} = \frac{u^3 dA}{V^3 A}$$

$$\text{Flatness Correction Factor} = \frac{U^4 dA}{V + A}$$

where:

V is the average velocity, u is the local velocity and A is the cross-sectional area of the diffuser.

The correction factors calculated for the velocity profiles given in Table 2 below:

TABLE II

| HOT WIRE DATA REDUCTION | | | | |
|---|---|---|---|---|
| INLET DIFFUSER | MOMENTUM CORRECTION | SKEWNESS/ENERGY CORRECTION | FLATNESS CORRECTION | AVERAGE TURBULENCE (RMS) |
| FIG. 2-5A | 1.22 | 1.59 | 2.15 | .28 |
| FIG. 2-5B | 1.24 | 1.70 | 2.41 | .28 |
| FIG. 2-5C | 1.22 | 1.65 | 2.35 | .29 |
| FIG. 1 | 1.21 | 1.65 | 2.41 | .46 |

Observation of the correction factors reveal that the embodiment in FIGS. 2–5A appears to have a slightly flatter velocity profile than those in FIGS. 2–5B and 2–5C. An ideal diffuser would have a flat velocity profile. And as the profile become more scewed (less flat), diffuser performance drops and pressure loss increases.

Most apparent is the significant difference between the velocity profiles of all the bent diffuser embodiments in FIGS. 2–5A, 2–5B and 2–5C and that of the prior art diffuser in FIG. 1. Although flatness of the profiles is similar between the inlets, turbulence is a lot greater in the straight diffuser. It was also observed that the straight diffuser vibrated and generated noise as opposed to the bent diffusers which were stabile and quiet throughout the tests. Observation of the profiles reveals that the bent diffusers definitely had higher flow velocity at the diffuser wall and that while the flow separated from the straight diffuser wall completely along the circumference of the inlet, the bent diffuser has flow on 75% of its wall with separation confined to the inside of the bend as earlier noted and shown in FIGS. 2 and 4. It is believed that the bend generates centrifugal force which in turn produces secondary flow shown by the arrows 30 in FIGS. 2 and 4 that retards separation on all faces of the diffuser wall except the inner bend region. As a result, the bent diffusers more stable flow and less static pressure loss.

Thus it is seen that the bent diffuser of the present invention is an effective device for controlling induction noise with low restriction. And that the bend makes the air cleaner inlet compatible with many underhood packaging constraints.

The foregoing description of the preferred embodiments of the invention have been presented for purposes of illustration and description. It is not intended to be exhaustive or to limit the invention to the precise form disclosed. Obvious modifications or variations are possible in light of the above teachings. The embodiments were chosen and described to provide the best illustration of the principles of the invention and its practical application to thereby enable one of ordinary skill in the art to utilize the invention in various embodiments and with various modifications as are suited to:the particular use contemplated. All such modifications and variations are within the scope of the invention as determined by the appended claims when interpreted in accordance with the breadth to which they are fairly, legally and equitably entitled. For example, theembodiments are all shown with a circular inlet and outlet and reference is made to their diameter but they could also be of some other suitable shape such as elliptical or oval and in that case have an equivalent diameter determined by their respective areas according to conventional fluid dynamics practice.

The embodiments of the invention in which an exclusive property or privilege is claimed are defined as follows:

1. An internal combustion engine air cleaner having a bent inlet diffuser comprising interconnected entry and exit stages having centerlines that intersect at an included angle of about 120° to 155° and flow areas that diverge along their respective centerline, said entry stage having a flow area that increases substantially uniformly along its centerline at a diffusion angle of about 10° to 20°, and said entry stage further having a length about 1.5 to 3 times the effective diameter of its entrance.

2. An internal combustion engine air cleaner having a bent inlet diffuser comprising interconnected entry and exit stages having centerlines that intersect at an included angle of about 120° to 155° and flow areas that diverge along their respective centerline, said entry stage having a flow area that increases substantially uniformly along its centerline at a diffusion angle of about 10° to 20°, said entry stage further having a length about 1.5 to 3 times the effective diameter of its entrance said entry stage having an entrance flow area of about 1.0 to 2.5", said exit stage having an exit flow area with an effective diameter of about 2.5 to 4.0".

3. An internal combustion engine air cleaner having a bent inlet diffuser comprising interconnected entry and exit stages having centerlines that intersect at an included angle of about 135° and flow areas that diverge along their respective centerline, said entry stage having a flow area that increases substantially uniformly along its centerline at a diffusion angle of about 15°, said entry stage further having a length about 1.5 to 3 times the effective diameter of its entrance, and said exit stage having an exit flow area about 4.0 times the entrance flow area of said entry stage.

* * * * *